US008458925B2

(12) United States Patent
Chen

(10) Patent No.: US 8,458,925 B2
(45) Date of Patent: Jun. 11, 2013

(54) SAFETY SHOE

(76) Inventor: Denise Chen, Tokyo (JP)

( * ) Notice: Subject to any disclaimer, the term of this patent is extended or adjusted under 35 U.S.C. 154(b) by 396 days.

(21) Appl. No.: 12/775,828

(22) Filed: May 7, 2010

(65) Prior Publication Data

US 2011/0271560 A1 Nov. 10, 2011

(51) Int. Cl.
*A43B 13/28* (2006.01)

(52) U.S. Cl.
USPC ..... 36/17 R

(58) Field of Classification Search
USPC ..... 36/12, 17 R, 17 A, 17 PW
See application file for complete search history.

(56) References Cited

U.S. PATENT DOCUMENTS 1,597,874 A * 8/1926 Arnold ..... 36/17 R
1,708,629 A * 4/1929 Lyon ..... 36/17 R
1,729,727 A * 10/1929 Lyon ..... 36/17 R
2,039,287 A * 5/1936 Arnold ..... 36/17 PW
2,201,383 A * 5/1940 Vizard ..... 36/17 R
2,275,574 A * 3/1942 Vizard ..... 36/17 R
2,339,525 A * 1/1944 Stritter ..... 36/17 R
2,345,738 A * 4/1944 Field ..... 36/17 R
3,046,679 A * 7/1962 Maertens et al. ..... 36/17 R
3,046,680 A * 7/1962 Hill et al. ..... 36/77 R
3,170,253 A * 2/1965 Johnson ..... 36/78
5,911,491 A * 6/1999 Huff ..... 36/17 R
6,601,319 B1 * 8/2003 Clements ..... 36/17 R
6,678,970 B2 * 1/2004 Liu ..... 36/12

* cited by examiner

*Primary Examiner* — Marie Patterson
(74) *Attorney, Agent, or Firm* — Steptoe & Johnson LLP

(57) ABSTRACT

A safety shoe includes a sole unit, an upper body, a protective toe cap, and a welt unit. The upper body includes an upper open end portion, a lower open end portion connected to the sole unit, and a vamp portion disposed between the upper and lower open end portions. The protective toe cap is disposed in the vamp portion of the upper body. The welt unit is mounted on the sole unit, surrounds the vamp portion, and has a stack of welt layers having different colors. A lowermost one of the welt layers has a bottom surface contacting the sole unit. An uppermost one of the welt layers has a top surface opposite to the lowermost one of the welt layers. A vertical distance between the top surface and the bottom surface is not smaller than 6 mm.

8 Claims, 10 Drawing Sheets

SAFETY SHOE

BACKGROUND OF THE INVENTION

1. Field of the Invention

This invention relates to a safety shoe, more particularly to a safety shoe having a welt unit.

2. Description of the Related Art

Referring to FIGS. 1 and 2, a conventional safety shoe comprises a sole unit 1, an insole 2, an upper body 3, a lining 4, a steel toe cap 5, and a welt unit 6. The upper body 3 is connected fixedly to the sole unit 1 and has a vamp portion 301. The lining 4 is disposed in the upper body 3. The steel toe cap 5 is disposed between the vamp portion 301 of the upper body 3 and the lining 4, and has a surrounding wall 501 and a flange 502 extending inwardly from a bottom edge of the surrounding wall 501. The welt unit 6 is mounted on the sole unit 1 and surrounds the upper body 3.

Generally, e.g. U.S. Men's shoe size 9, an average thickness of each of the surrounding wall 501 and the flange 502 of the steel toe cap 5 is 2 mm, such that the vamp portion 301 of the upper body 3 has a relatively large thickness. However, since a height of the welt unit 6 is generally 2 mm, only a relatively small portion of the vamp portion 301 can be covered by the welt unit 6, thereby affecting adversely the visual aesthetic quality of the conventional safety shoe. As a result, users would not like to wear the conventional safety shoes as casual shoes.

SUMMARY OF THE INVENTION

Therefore, the object of the present invention is to provide a safety shoe capable of alleviating the above drawbacks of the prior art.

Accordingly, a safety shoe of the present invention comprises a sole unit, an upper body, a protective toe cap, and a welt unit. The upper body includes an upper open end portion, a lower open end portion disposed under the upper open end portion and connected to the sole unit, and a vamp portion disposed between the upper open end portion and the lower open end portion. The protective toe cap is disposed in the vamp portion of the upper body. The welt unit is mounted on the sole unit, surrounds the vamp portion, and has a stack of welt layers having different colors. A lowermost one of the welt layers has a bottom surface that contacts the sole unit. An uppermost one of the welt layers has a top surface that is opposite to the lowermost one of the welt layers. A vertical distance between the top surface of the uppermost one of the welt layers and the bottom surface of the lowermost one of the welt layers is not smaller than 6 mm, such that a portion of the vamp portion of the upper body is covered by the welt unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
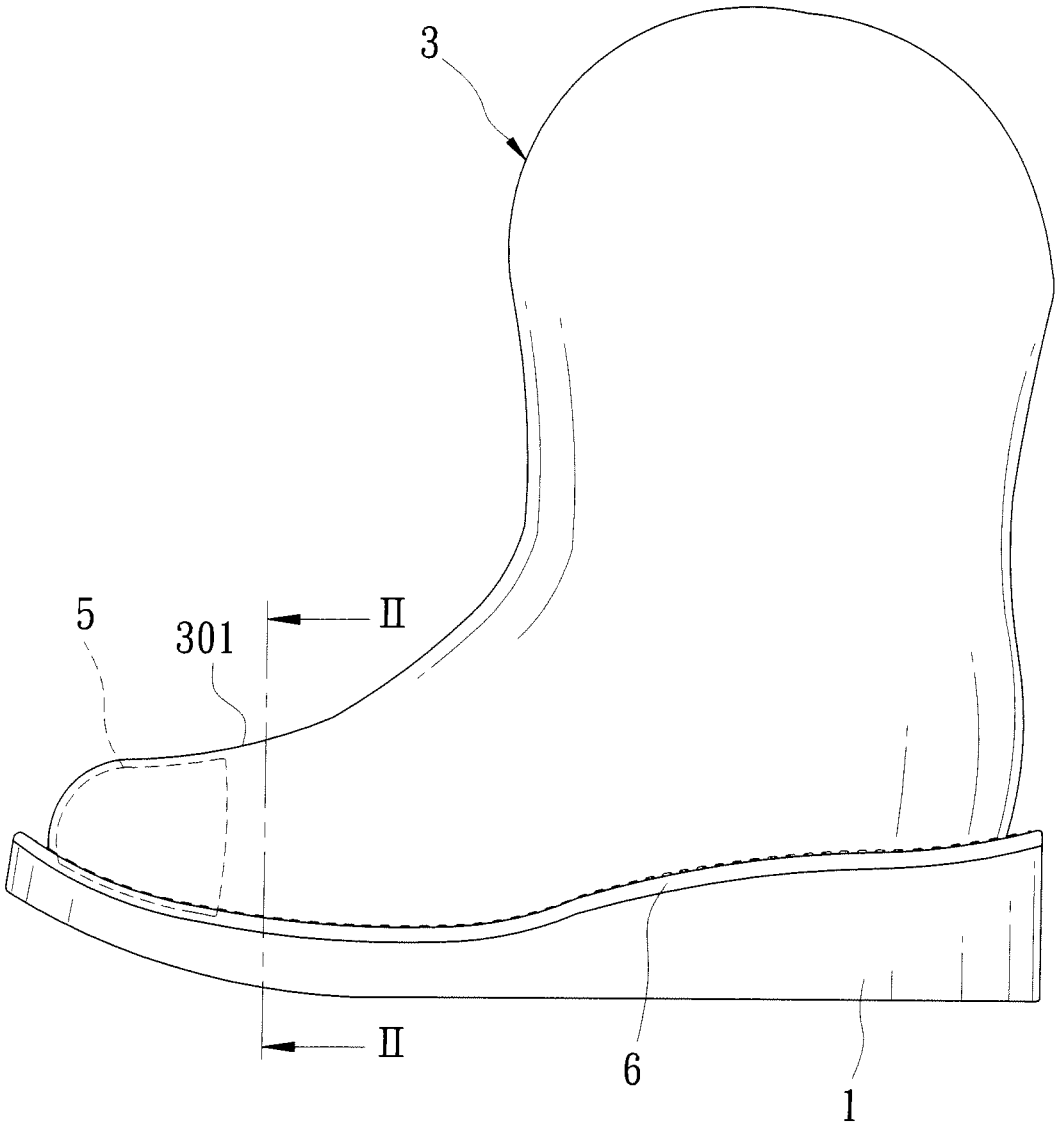
FIG. 1 PRIOR ART
FIG. 1 is a side view of a conventional safety shoe.
Figure 2:
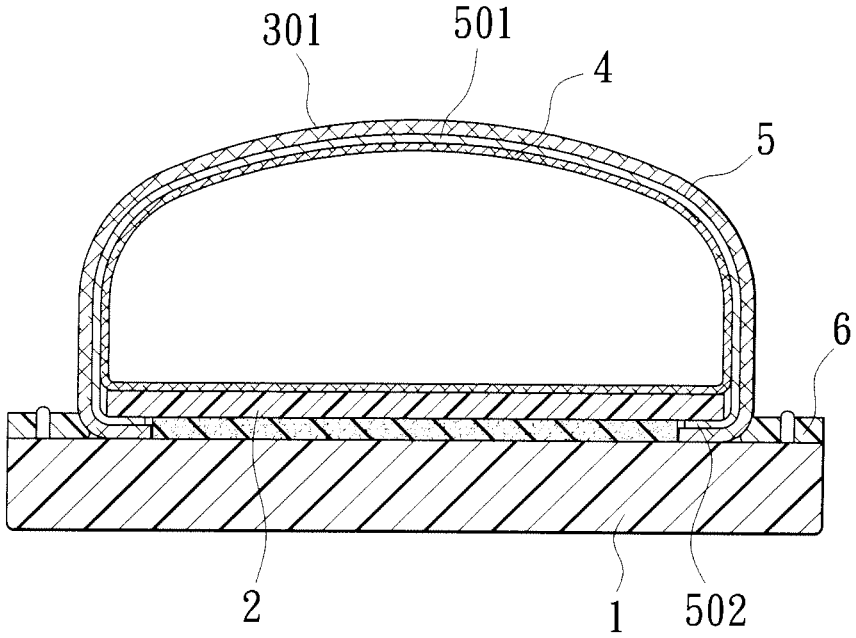
FIG. 2 PRIOR ART
FIG. 2 is a sectional view taken along line II-II in FIG. 1.

Before the present invention is described in greater detail, it should be noted that like reference numerals are used to indicate corresponding or analogous elements throughout the accompanying disclosure.

Figure 3:
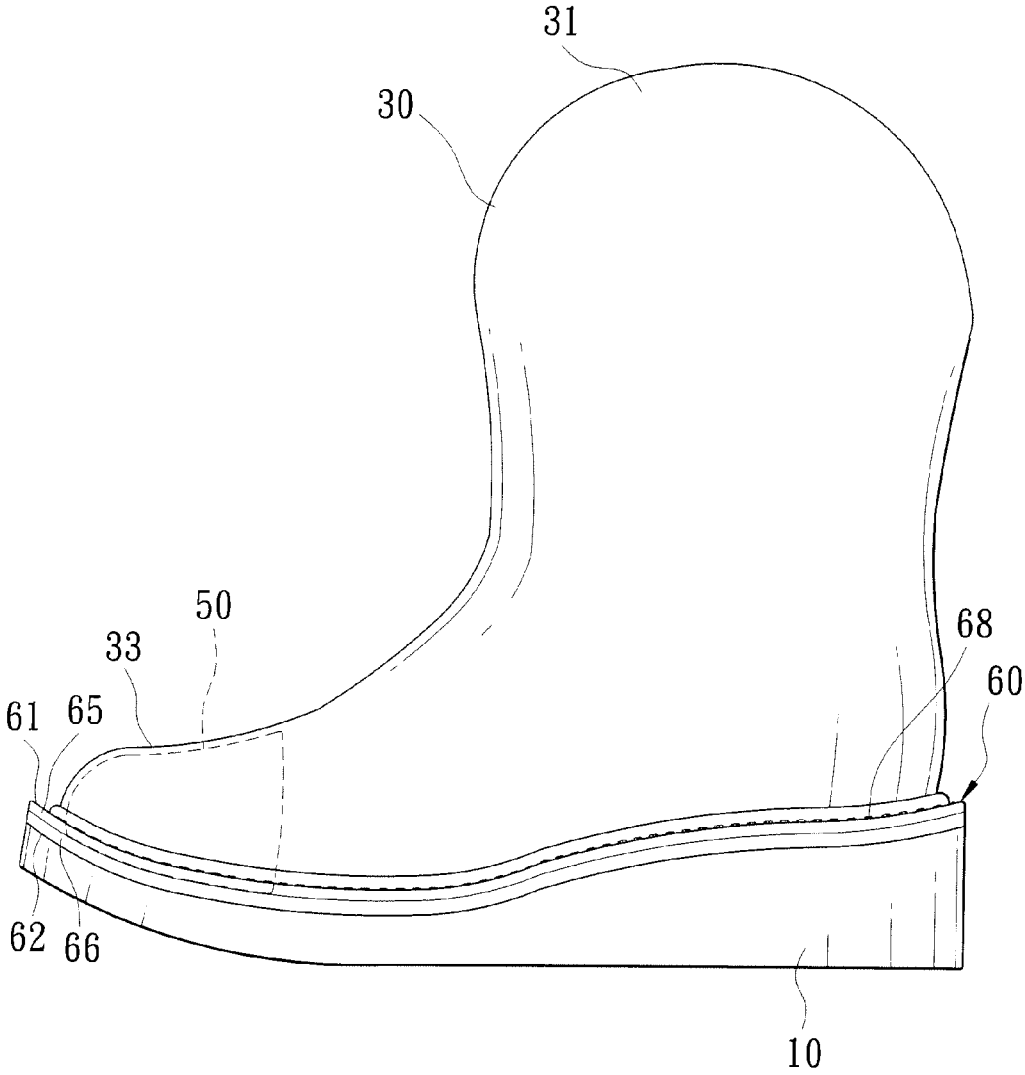
FIG. 3 is a side view of a first preferred embodiment of a safety shoe according to the present invention.
Figure 4:
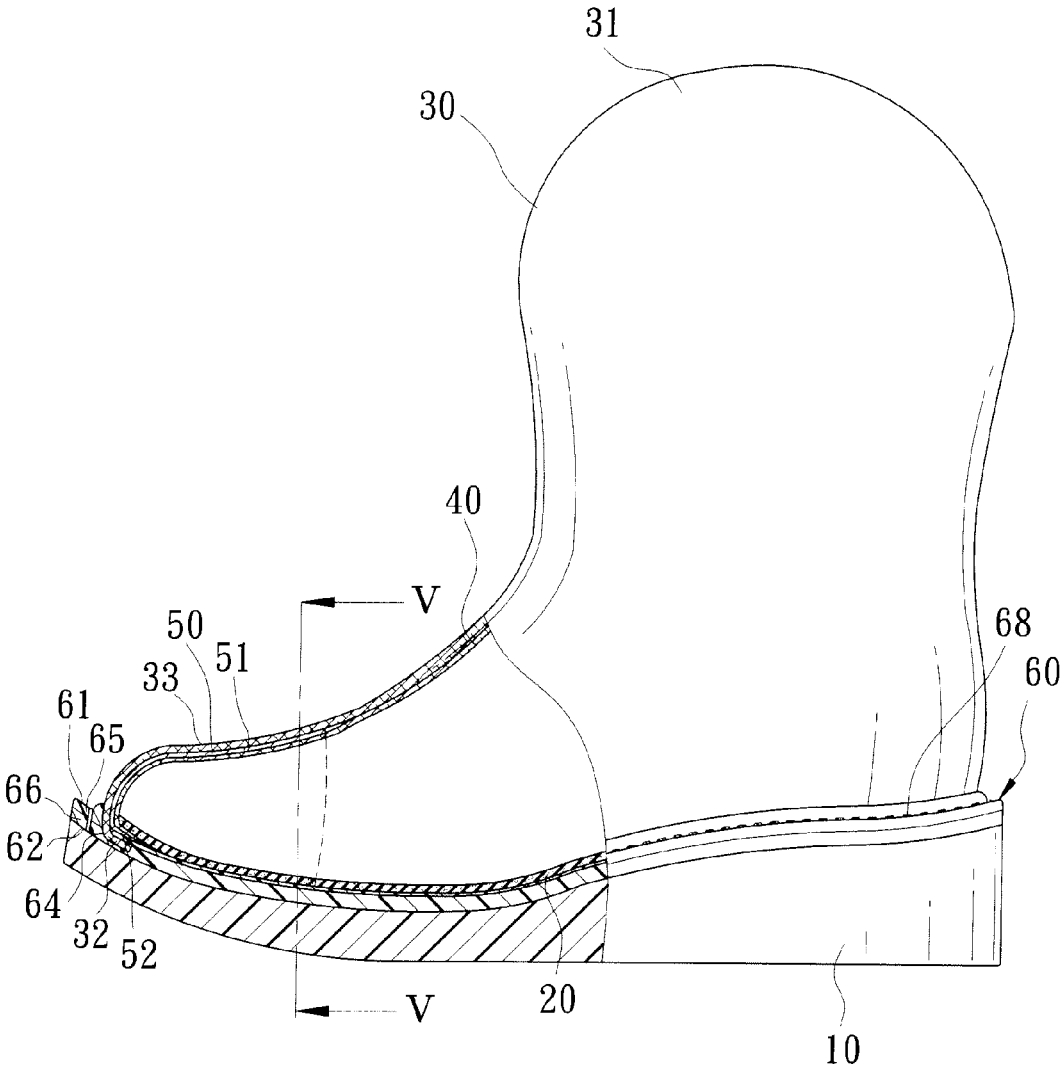
FIG. 4 is a partly sectional view of the first preferred embodiment.
Figure 5:
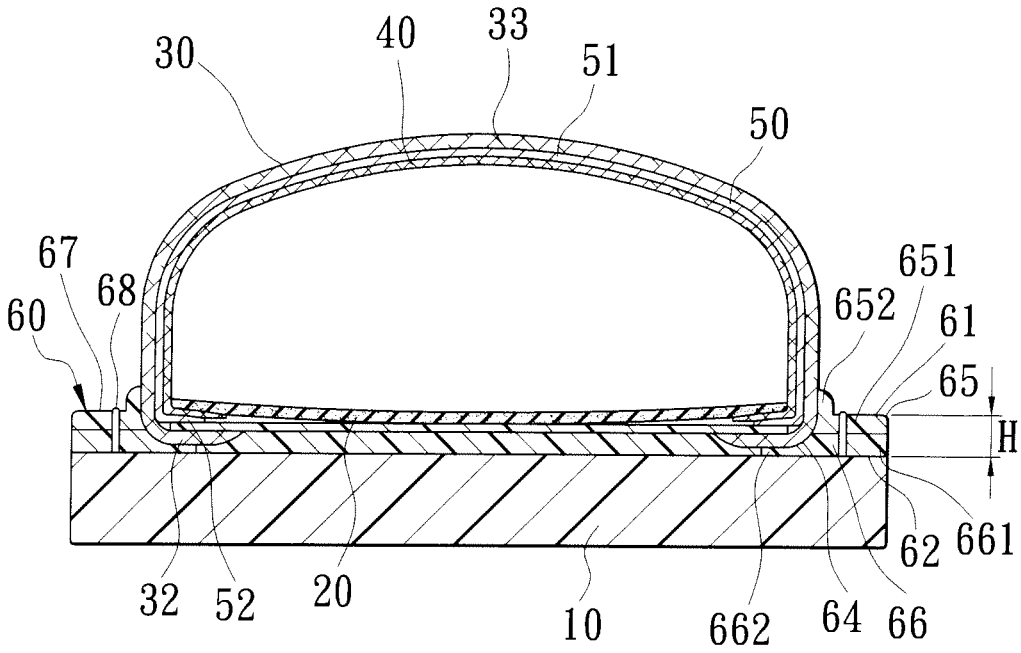
FIG. 5 is a sectional view taken along line V-V in FIG. 4.

Referring to FIGS. 3 to 5, a first preferred embodiment of a safety shoe according to the present invention is shown. The safety shoe comprises a sole unit 10, an insole 20, an upper body 30, a lining 40, a protective toe cap 50, and a welt unit 60.

The upper body 30 includes an upper open end portion 31, a lower open end portion 32 disposed under the upper open end portion 31 and connected to the sole unit 10, and a vamp portion 33 disposed between the upper open end portion 31 and the lower open end portion 32. The lining 40 is disposed in the upper body 30.

The protective toe cap 50 is disposed between the vamp portion 33 of the upper body 30 and the lining 40. The protective toe cap 50 includes a surrounding wall 51, and a flange wall 52 extending inwardly from a bottom edge of the surrounding wall 51. In this embodiment, the protective toe cap 50 is made of steel, aluminum, synthetic resin, or a composite material. The thickness of each of the surrounding wall 51 and the flange wall 52 is substantially equal to 2 mm.

Figure 6:
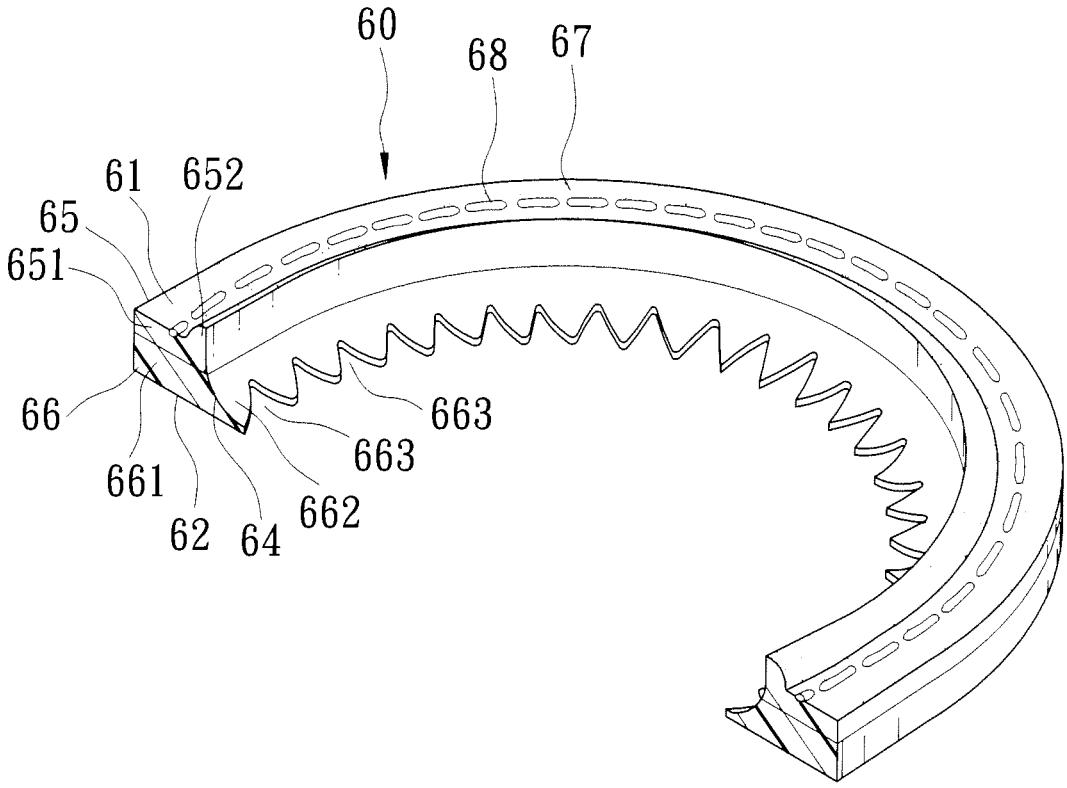
FIG. 6 is a fragmentary perspective view of a welt unit of the first preferred embodiment.

Further referring to FIG. 6, the welt unit 60 is mounted on the sole unit 10, surrounds the vamp portion 33 of the upper body 30, and has a top welt layer 65 and a bottom welt layer 66. It should be noted that the welt unit 60 may have a stack of welt layers in other embodiment.

The bottom welt layer 66 of the welt unit 60 is mounted on the sole unit 10 and has a base part 661 and a flange part 662. The flange part 662 extends inwardly from an inner end of the base part 661 and is clamped between the lower open end portion 32 of the upper body 30 and the sole unit 10. The base part 661 and the flange part 662 are formed cooperatively with a bottom surface 62 that contacts the sole unit 10. The flange part 662 has an inner edge formed with a plurality of notches 663, such that the welt unit 60 is able to be bent into a curve and be positioned on the sole unit 10.

Figure 7:
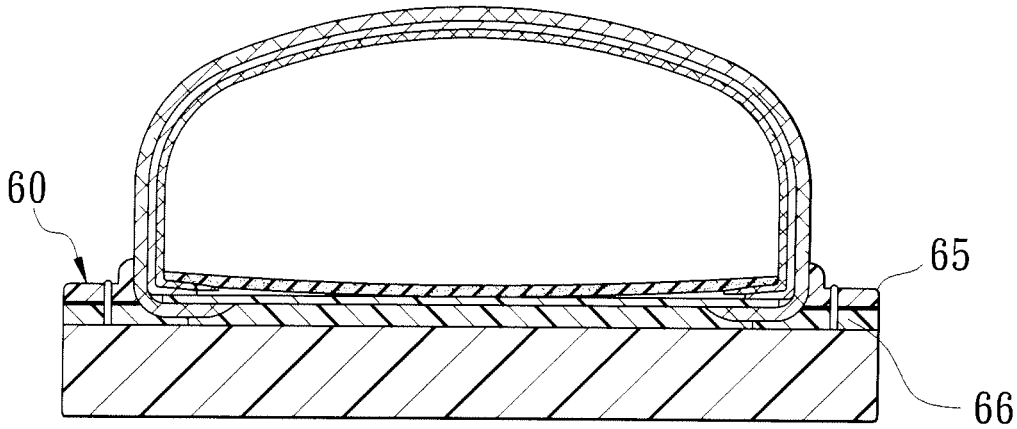
FIG. 7 is a sectional view similar to FIG. 5, illustrating a modification of the safety shoe.

The top welt layer 65 is stacked on the bottom welt layer 66, and has a base portion 651 and a flange portion 652. The base portion 651 of the top welt layer 65 is formed with a top surface 61. The flange portion 652 of the top welt layer 65 projects from an inner end of the top surface 61 of the base portion 651 away from the sole unit 10 and is disposed adjacent to the vamp portion 33 of the upper body 30 for covering a portion of the upper body 30. In this embodiment, the top and bottom welt layers 65, 66 of the welt unit 60 are connected integrally to each other, have different colors or different shades of the same color, and are made of the same material. It should be noted that the top and bottom welt layers 65, 66 of the welt unit 60 may be made separately using different materials in other embodiments of this invention (see FIG. 7).

A vertical distance (H) defined between the top surface 61 of the base portion 651 of the top welt layer 65 and the bottom surface 62 of the bottom welt layer 66 is not smaller than 6 mm. The welt unit 60 further has a decorative thread 68 sewed on the base portion 651 of the top welt layer 65 and the base part 661 of the bottom welt layer 66 for decoration. It should be noted that the decorative thread 68 may be only sewed on the base portion 651 of the top welt layer 65 in other embodiments.

In this embodiment, the welt unit 60 further has a curved inner peripheral surface 64 formed on the flange portion 652 and the base portion 651 of the top welt layer 65 and the base part 661 and the flange part 662 of the bottom welt layer 66, and abutting against the lower open end portion 32 of the upper body 30. In this embodiment, the top surface 61 and the flange portion 652 of the top welt layer 65 are covered with a paint coating 67 that has a color different from that of the top welt layer 65.

To sum up, the advantages of the present invention are as follows. The inner peripheral surface 64 of the welt unit 60 provides a relatively large contact area of the welt unit 60 to the vamp portion 33 of the upper body 30 to thereby result in a firm connection between the welt unit 60 and the vamp portion 33 of the upper body 30. Further, compared to the aforementioned conventional safety shoe, since the vertical distance (H) between the top surface 61 of the base portion 651 of the top welt layer 65 and the bottom surface 62 of the bottom welt layer 66 is not smaller than 6 mm, the portion of the vamp portion 33 of the upper body 30 that is covered by the welt unit 60 is effectively increased, thereby improving the visual aesthetic quality of the safety shoe of this invention.

Moreover, since the top welt layer 65 and the bottom welt layer 66 are made in different colors or shades, the bottom welt layer 66 may have a color or a shade look like a layer of the sole unit 10 so as to create a visual impression that makes the welt unit 60 seem thinner than it actually is. Under this circumstance, a thinner sole unit 10 may be employed to reduce the manufacturing cost and the total weight of the safety shoe.

In addition, the welt unit 60 may be made to have different vertical heights (H) to correspond with the vamp portion 33 of the upper body 30 in other embodiments of the invention so as to result in a balanced visual impression of the safety shoe.

Figure 8:
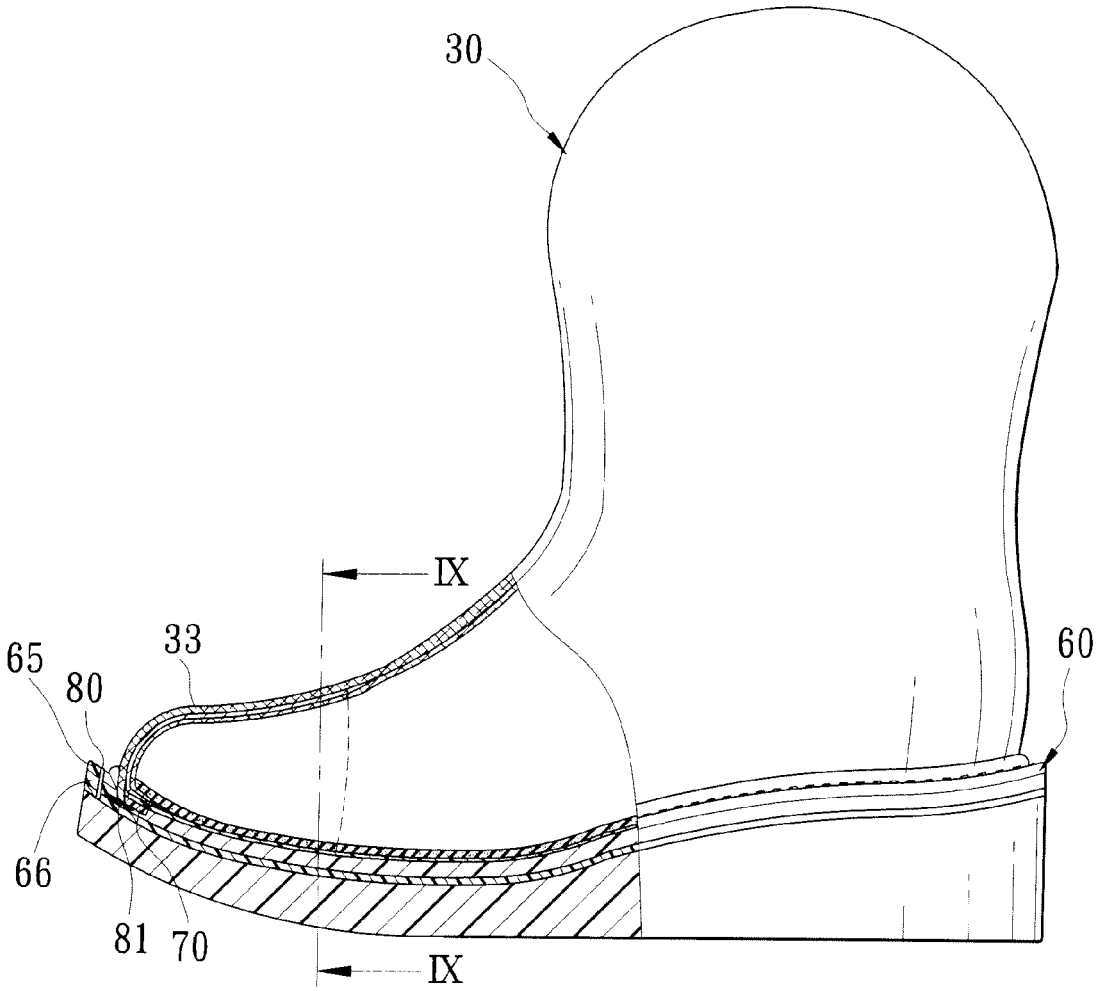
FIG. 8 is a partly sectional view of a second preferred embodiment of the safety shoe according to the present invention.
Figure 9:
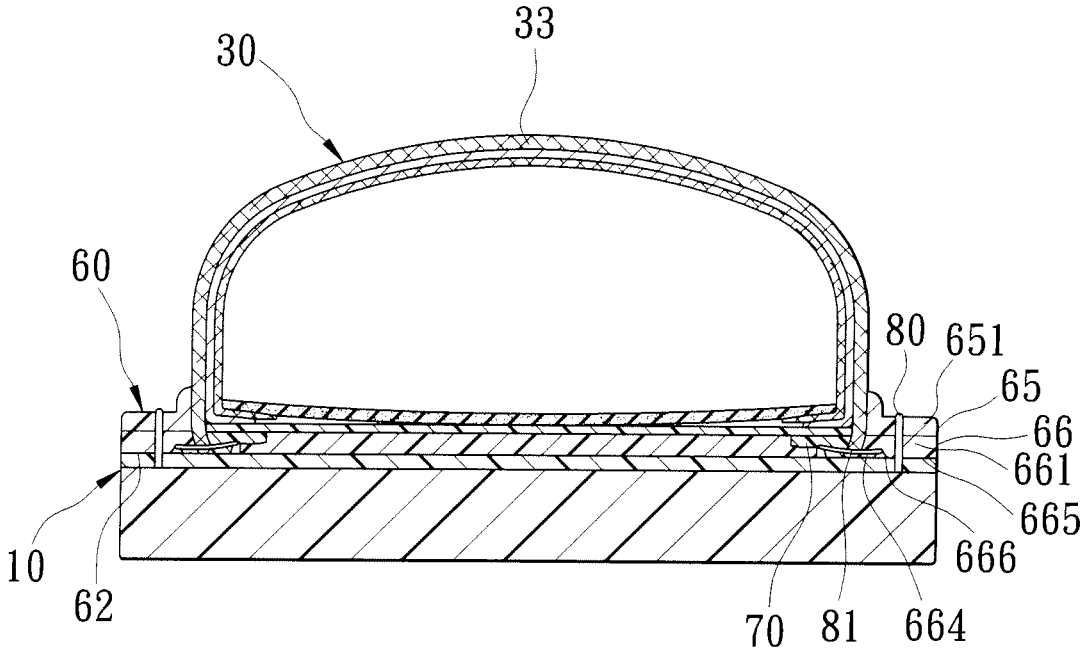
FIG. 9 is a sectional view taken along line XI-XI in FIG. 8.
Figure 10:
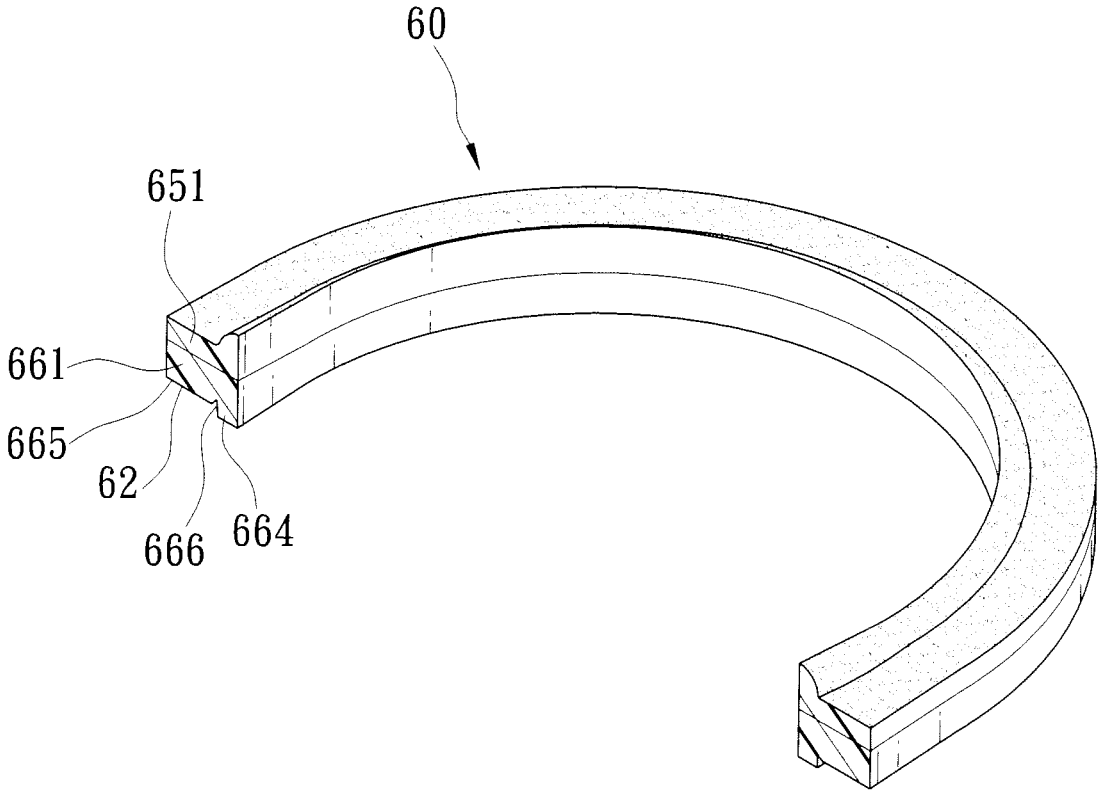
FIG. 10 is a fragmentary perspective view of a welt unit of the second preferred embodiment.

Referring to FIGS. 8 to 10, a second preferred embodiment of the safety shoe of the present invention is shown. The main difference between the second embodiment and the first embodiment resides in the following. The bottom welt layer 66 of the welt unit 60 has an inner part 664 proximate to the vamp portion 33 of the upper body 30, an outer part 665 distal from the vamp portion 33 of the upper body 30 and formed with the bottom surface 62, and a groove 666 formed between the inner part 664 and the outer part 665. The base portion 651 of the top welt layer 65, the base part 661 of the bottom welt layer 66, and the sole unit 10 are sewn together by a thread 80. The safety shoe of this embodiment further comprises an inner welt 70 that is mounted on the sole unit 10, that is disposed in the upper body 30, and that is stitched to the inner part 664 of the bottom layer 66 of the welt unit 60 and the vamp portion 33 of the upper body 30 by another thread 81. The second preferred embodiment has the same advantages as those of the first preferred embodiment.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A safety shoe comprising:

a sole unit;

an upper body including an upper open end portion, a lower open end portion that is disposed under said upper open end portion and that is connected to said sole unit, and a vamp portion that is disposed between said upper open end portion and said lower open end portion;

a protective toe cap disposed in said vamp portion of said upper body; and a welt unit mounted on said sole unit, surrounding said vamp portion, and having a stack of welt layers having different colors, a lowermost one of said welt layers having a bottom surface that contacts said sole unit, an uppermost one of said welt layers having a top surface that is opposite to said lowermost one of said welt layers;

wherein a vertical distance between said top surface of the uppermost one of said welt layers and said bottom surface of the lowermost one of said welt layers is not smaller than 6 mm such that a portion of said vamp portion of said upper body is covered by said welt unit;

wherein said welt unit has:

a bottom welt layer formed with said bottom surface; and a top welt layer stacked on said bottom welt layer and having a base portion that is formed with said top surface and a flange portion that projects in a direction from an inner end of said top surface of said base portion away from said sole unit and that is disposed adjacent to said vamp portion of said upper body;

wherein:

said bottom welt layer of said welt unit has a base part and a flange part that extends inwardly from an inner end of said base part and that is clamped between said lower open end portion of said upper body and said sole unit, said base part and said flange part being formed cooperatively with said bottom surface; and said welt unit further has an inner peripheral surface that is formed on said flange portion and said base portion of said top welt layer and said base part and said flange part of said bottom welt layer, and that abuts against said lower open end portion of said upper body; and wherein said top welt layer and said bottom welt layer of said welt unit are connected integrally to each other.

2. The safety shoe as claimed in claim 1, wherein said flange part of said bottom welt layer of said welt unit has a plurality of notches formed at an inner edge of said flange part.

3. The safety shoe as claimed in claim 1, wherein said inner peripheral surface of said welt unit is a curved surface.

4. The safety shoe as claimed in claim 1, wherein said welt unit further has a decorative thread sewed on said base portion of said top welt layer and said base part of said bottom welt layer for decoration.

5. The safety shoe as claimed in claim 1, wherein said bottom welt layer of said welt unit has an inner part proximate to said vamp portion of said upper body, an outer part distal from said vamp portion of said upper body and formed with said bottom surface, and a groove formed between said inner part and said outer part, said inner part of said bottom welt layer being stitched to said vamp portion of said upper body.

6. The safety shoe as claimed in claim 1, wherein said welt unit further has a paint coating covering said top surface of the uppermost one of said welt layers.

7. The safety shoe as claimed in claim 1 further comprising a lining disposed in said upper body, said protective toe cap being disposed between said upper body and said lining.

8. The safety shoe as claimed in claim 1, wherein said welt layers of said welt unit are made of different materials.

* * * * *